United States Patent [19]

Mandigo et al.

[11] Patent Number: 4,715,910

[45] Date of Patent: Dec. 29, 1987

[54] LOW COST CONNECTOR ALLOY

[75] Inventors: Frank N. Mandigo, Northford; Eugene Shapiro, Hamden, both of Conn.

[73] Assignee: Olin Corporation, New Haven, Conn.

[21] Appl. No.: 882,878

[22] Filed: Jul. 7, 1986

[51] Int. Cl.[4] ..... C22C 9/01

[52] U.S. Cl. ..... 148/414; 148/435; 148/436; 420/486; 420/489; 420/494

[58] Field of Search ..... 420/486, 489, 494; 148/11.5 C, 160, 414, 432, 435, 436

[56] References Cited

U.S. PATENT DOCUMENTS

| | | | |
|---|---|---|---|
| 1,496,269 | 6/1924 | Iytaka | 420/485 |
| 1,612,642 | 12/1926 | Mudge | 420/486 |
| 2,101,930 | 2/1937 | Davis et al. | 420/479 |
| 2,157,934 | 5/1939 | Hensel et al. | 420/486 |
| 2,851,353 | 9/1953 | Roach et al. | 420/486 |
| 4,016,010 | 4/1977 | Caron et al. | 148/12.7 C |
| 4,025,367 | 5/1977 | Parikh et al. | 148/11.5 C |
| 4,047,978 | 9/1977 | Parikh et al. | 148/11.5 C |
| 4,073,667 | 2/1978 | Caron et al. | 148/12.7 C |
| 4,110,132 | 8/1978 | Parikh et al. | 148/11.5 C |
| 4,401,488 | 8/1983 | Prinz et al. | 148/435 |
| 4,434,016 | 2/1984 | Saleh et al. | 148/12.7 C |
| 4,594,117 | 6/1986 | Pryor et al. | 148/436 |
| 4,594,221 | 6/1986 | Caron et al. | 420/494 |

FOREIGN PATENT DOCUMENTS 0041096 12/1967 Japan .

OTHER PUBLICATIONS

"Copper-Rich Ni-Al-Cu Alloys, Part 1—The Effect of Heat Treatment on Hardness and Electrical Resistivity", by W. O. Alexander et al., *J. Inst. of Metals* 61, (1937), 83; "Copper-Rich Ni-Al-Cu-Alloys, Part 2—The Constitution of the Cu-Ni Rich Alloys", by W. O. Alexander et al., *ibid.*, 63, (1938), 163; and "Copper-Rich Ni-Al-Cu Alloys", Part 3—The Effect of Heat Treatment in Microstructures", by W. O. Alexander et al., *ibid.*, 64, (1939), 217.

*Primary Examiner*—L. Dewayne Rutledge
*Assistant Examiner*—George Wyszomierski
*Attorney, Agent, or Firm*—Paul Weinstein

[57] ABSTRACT

The present invention relates to a copper base alloy consisting essentially of from about 3.5% to about 6.0% aluminum, from about 0.1% to about 3.0% nickel, from about 0.03% to about 1.0% magnesium and the balance essentially copper. The alloys of the present invention have been found to be cost effective and easily processable. They have also been found to have particular utility in electronic and electrical applications such as electrical connectors.

17 Claims, 5 Drawing Figures

LOW COST CONNECTOR ALLOY

The present invention relates to a copper base alloy containing from about 3.5% to about 6.0% aluminum, from about 0.1% to about 3.0% nickel, and from about 0.03% to about 1.0% magnesium. The alloy has utility in electrical and electronic connector applications.

Copper-nickel-aluminum alloys have been found to be useful in a variety of applications including coinage and heat exchanger applications. U.S. Pat. No. 1,496,269 to Iytaka for example illustrates a copper-nickel alloy containing less than 11% aluminum and having a number of different uses with the nickel content of the alloy being dependent upon the intended use. Iytaka suggests that alloys containing from 3% to 25% nickel could be used for locomotive fire box plates and boiler tubes, while alloys containing 40% nickel could be used for thermojunction and electric resistance wires. U.S. Pat. No. 2,101,930 to Davis et al. and Japanese Pat. Publication No. 53-41096 illustrate copper-nickel-aluminum alloys having utility in heat exchanger applications. U.S. Pat. No. 4,401,488 to Prinz et al. relates to a copper-nickel-aluminum alloy for use in coinage applications. The alloy consists essentially of from 4% to 6% nickel, from 4% to 6% aluminum, balance copper. The alloy may also contain 0.5% to 1.8% iron, 0.05% to 0.3% silicon, and/or 0.3% to 1.5% manganese.

U.S. Pat. No. 1,612,642 to Mudge relates to a method of manufacturing an aluminum-copper-nickel alloy containing up to 17% aluminum, preferably from 2% to 7% aluminum, from about 1% to 90% copper, preferably over 10% copper, and the remainder nickel, preferably greater than 40%. While Mudge discusses the addition of magnesium to a preliminary aluminum alloy to be added to a copper-nickel alloy during processing to provide deoxidation and to improve malleability, there is no discussion of the magnesium content in the final alloy.

Copper-nickel and copper-nickel-aluminum alloys have also been used in electrical applications for connectors, current carrying springs, and spring contact members. This is because these alloys tend to possess high strength, good bend formability, and good resistance to mechanical property degradation at moderately elevated temperatures. U.S. Pat. Nos. 2,157,934 to Hensel et al. and 2,851,353 to Roach et al. illustrate some of the alloys used in electrical applications. The Hensel et al. alloys contain from 0.1% to 5.0% of a material selected from the group consisting of iron, nickel and cobalt, from 0.1% to 3.0% magnesium, from 0.1% to 3.0% silicon and the balance copper. The Roach et al. alloys contain nickel, silicon and at least one of aluminum and magnesium in addition to copper. The nickel content of these alloys, however, is in the range of about 5% to about 15% which makes the alloys expensive and economically undesirable.

It is known that copper base alloys containing nickel and aluminum can be precipitation hardened. "Copper-Rich Ni-Al-Cu Alloys, Part 1—The Effect of Heat Treatment on Hardness and Electrical Resistivity," by W. O. Alexander et al., J. Inst. of Metals, 61(1937)83; "Copper-Rich Ni-Al- Cu Alloys, Part 2—The Constitution of the Cu-Ni Rich Alloys," by W. O. Alexander et al., ibid., 63(1938)163; and "Copper-Rich Ni-Al-Cu Alloys, Part 3—The Effect of Heat Treatment in Microstructures," by W. O. Alexander et al., ibid., 64(1939)217, discuss precipitation hardenable copper-nickel-aluminum alloys. U.S. Pat. No. 4,434,016 to Saleh et al. relates to a precipitation hardenable copper base alloy having utility in electrical spring applications. This alloy consists essentially of from about 10% to about 15% nickel, from about 1% to about 3% aluminum, up to about 1% manganese, from about 0.05% to less than about 0.5% magnesium and the balance copper.

U.S. Pat. Nos. 4,016,010 and 4,073,667 both to Caron et al. illustrate a method for obtaining precipitation hardened copper base alloys via continuous, coherent precipitation such as spinodal decomposition. The method described therein comprises cooling the alloy from a solution heat treatment at a controlled rate so as to cause spinodal decomposition of the alloy and the provision of a precipitation microstructure having higher aged strengths and better resistance to stress relaxation than that obtained in a water quenched and aged alloy. The method is disclosed as being applicable to copper-nickel-aluminum alloy systems such as those containing 5 to 30% nickel and 0.5 to 5% aluminum.

Copper-beryllium alloys such as alloy C170 and tin bronzes such as copper alloy C510 have also been used in electrical and electronic connector applications. These alloys are also expensive and economically unattractive because of the costs associated with beryllium and tin. In addition, copper-beryllium alloys often require precise control during processing and fabrication.

Accordingly, it is an object of the present invention to provide a low cost copper base alloy having utility in connector applications.

It is a further object of the present invention to provide a copper base alloy as above that is relatively easy to process.

It is still a further object of the present invention to provide a copper base alloy as above that is compatible with in-line annealing and cleaning techniques.

These and other objects and advantages will become apparent from the following description and drawings.

The alloy system of the present invention achieves the foregoing objects by utilizing additions of aluminum, nickel, and magnesium in a copper base. Alloys in accordance with the present invention consist essentially of from about 3.5% to about 6.0% aluminum, from about 0.1% to about 3.0% nickel, from about 0.03% to about 1.0% magnesium and the balance essentially copper. These alloys generally contain copper in an amount greater than 90.0%. As used herein, the percentages for each alloy constituent are weight percentages.

In a preferred embodiment, the alloy system of the present invention consists essentially of from about 3.8% to about 5.2% aluminum, from about 0.2% to about 1.0% nickel, from about 0.05% to about 0.4% magnesium and the balance essentially copper. In these systems, copper is generally present in an amount greater than about 93.0%. In a most preferred embodiment, the alloy system consists essentially of from about 4.2% to about 4.9% aluminum, from about 0.3% to about 0.8% nickel, from about 0.1% to about 0.25% magnesium and the balance essentially copper.

The alloys of the present invention are particularly useful in electrical and electronic connector applications because they possess excellent strength-to-bend performance and stress relaxation properties. The alloys are also useful because they are relatively easy to process. For example, alloys in accordance with the present invention are hot and cold rollable and may be processed using in-line strip annealing and cleaning techniques. The alloys of the present invention also provide a significant cost savings over materials currently being used in similar applications.

Figure 1:
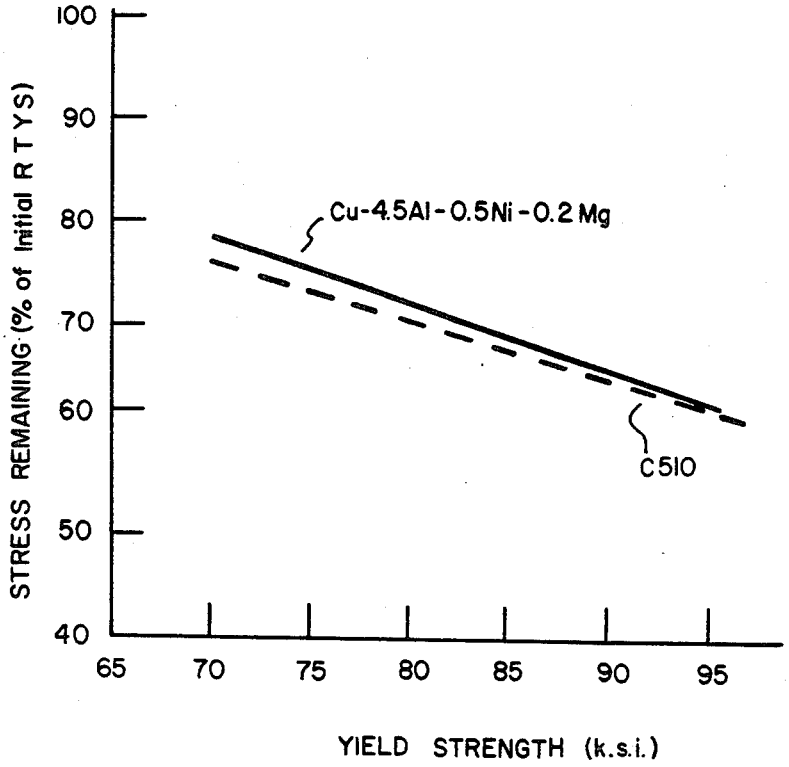
FIG. 1 is a graph illustrating the stress relaxation performance of an alloy in accordance with the present invention as compared to that of copper alloy C510.

As previously discussed, the alloys of the present invention have been found to have particular utility in electrical and electronic connector applications. This is because they possess excellent strength-to-bend and stress relaxation properties. These alloys are also cost effective because of their low mix value and relatively easy to process. For example, the alloys of the present invention are both hot and cold rollable and amenable to in-line strip annealing and cleaning in non-oxidizing acid solutions. Still further, the alloys of the present invention are solid solution strengthened and do not require thermal treatments to obtain the desired levels of strength properties.

Copper base alloys in accordance with the present invention contain aluminum, nickel, and magnesium within certain critical limits. These alloys consist essentially of from about 3.5% to about 6.0% aluminum, from about 0.1% to about 3.0% nickel, from about 0.03% to about 1.0% magnesium and the balance essentially copper. It has been found that the amount of aluminum in these alloys plays an important role in determining the strength-to-bend performance properties of the alloys. The lower limit for the alloy's aluminum content is set to achieve the desired improvements in strength-to-bend performance. The upper limit for the aluminum content is set by the requirement that the alloy be at least about 65% cold rollable. The upper limit on the aluminum content has also been set to make the alloys less sensitive to low temperature treatments. At aluminum levels above 6%, copper-nickel-aluminum alloys become sensitive to low temperature treatments and demonstrate less consistent mechanical properties. The compositional range given above for nickel has also been selected from the standpoint of providing excellent strength-to-bend performance.

The magnesium addition to the alloy has been been found to provide two desirable effects. Magnesium within the foregoing compositional range improves the stress relaxation performance of the alloy. It also assists in forming during thermal treatments a surface oxide that can be easily removed by immersion in non-oxidizing acid solutions. The upper limit for the alloy's magnesium content is imposed by the need to facilitate processing. At magnesium levels above 1.0%, processing becomes more difficult, particularly in terms of hot rollability.

In a preferred embodiment, the alloy system of the present invention consists essentially of from about 3.8% to about 5.2% aluminum, from about 0.2% to about 1.0% nickel, from about 0.05% to about 0.4% magnesium and the balance essentially copper. In a most preferred embodiment, the alloys of the present invention consist essentially of from about 4.2% to about 4.9% aluminum, from about 0.3% to about 0.8% nickel, from about 0.1% to about 0.25% magnesium and the balance essentially copper. It has been found that the aluminum level in the most preferred embodiment provides an exceptional combination of strength-to-bend performance and alloy stability during low temperature exposure.

Alloys in accordance with the present invention may also contain up to about 0.1% manganese, up to 0.05% iron and cobalt together, up to about 0.005% chromium, up to about 0.3% zinc, up to about 0.05% tin, up to about 0.05% silicon, up to about 0.015% lead, and up to about 0.005% phosphorous. Conventional brass mill impurities may be tolerated in the alloys of the present invention but should preferably be kept at a minimum.

The alloys of the present invention may be cast in any desired manner. For example, they may be cast using continuous casting, direct chill casting or Durville casting techniques. Any suitable pouring temperature may be used during casting.

After casting, the alloys may also be processed in any desired manner. Typically, the alloys are processed by breaking down the cast ingot into a strip material such as sheet or plate by hot working the ingot such as by hot rolling and thereafter cold working the material such as by cold rolling. During the cold working phase, the material may be subjected to one or more passes through a rolling mill until it reaches a desired gauge. If necessary, one or more interanneals may be performed during the cold rolling phase. The final strip material may have any desired temper and may be further cold worked and/or annealed to provide that temper. The various hot working, cold working, and/or annealing steps may be performed using any conventional technique and apparatus known in the art.

Hot rolling when used may be started at any suitable initial temperature. For example, the initial hot rolling temperature may be in the range from about 800° C. to about 950° C. Preferably, the initial hot rolling temperature is in the range of from about 850° C. to about 900° C. Any suitable cooling rate may be used to cool the strip material after hot rolling. If needed, the strip material may be subjected to coil milling after hot rolling.

The alloys of the present invention are believed to be capable of taking cold rolling reductions up to about 90%. Normally, processing will entail taking cold rolling reductions in the range of from about 50% to about 90%. The cold rolling reductions needed to obtain a desired gauge may, if desired, be taken in one or more rolling passes.

Annealing of these alloys can be performed either using strip annealing or bell annealing techniques. Strip annealing is preferred; however, because it allows in-line cleaning techniques to be employed. Bell annealing generally means that cleaning has to be performed off-line. Annealing of the alloys of the present invention may be performed at a temperature in the range of from about 400° C. to about 900° C. for time periods in the range of from about 15 seconds to about 8 hours.

If desired, the alloys of the present invention may be given a final cold roll to temper and/or a stabilization anneal. The final cold rolling step may be performed using reductions in the range of from about 10% to about 75%. Of course, the amount of reduction taken depends upon the desired temper and final gauge for the material. The stabilization anneal may be performed at a temperature from about 200° C. to about 300° C. for a time in the range of from about 1 hour to about 8 hours.

After processing has been completed, the strip material may be fabricated into any desired article. As previously discussed, it has been found that the alloys of the present invention have particular utility in electrical and electronic connector applications. This is because the alloys possess excellent strength-to-bend and stress relaxation properties. Any suitable fabrication technique known in the art may be used to fabricate the strip material into the desired article.

It has been discovered that one can obtain particularly improved strength-to-bend performance such as improved bad way bend performance by subjecting the alloys of the present invention during cold working to a plurality of heat treatments designed to create certain grain sizes within the alloy at various stages of processing. These heat treatments preferably include an intermediate heat treatment for producing a grain size in the alloy coarser than or at least equal to a desired final grain size. For example, strip material at RGR (Ready-to-get-Ready) gauge may be annealed at a temperature in the range of from about 425° C. to about 550° C. for a time period in the range of from about 1 to about 4 hours to obtain a grain size in the range of about 5 microns to about 20 microns. The material may then be further cold worked to a RF (Ready to Finish) gauge and annealed at a temperature in the range of from about 400° C. to about 525° C. for about 1 to 4 hours to obtain a grain size in the range of from about 4 microns to about 10 microns. For the reasons previously mentioned, the grain size produced by the anneal at RGR gauge should preferably be coarser than the grain size produced by the anneal at RF gauge. If desired, the material thus processed may be further worked to produce a desired temper and/or final gauge.

The present invention and the improvements resulting therefrom will be more readily apparent from a consideration of the following illustrative examples.

EXAMPLE I

An alloy in accordance with the present invention having a nominal composition of 4.5% aluminum, 0.5% nickel, 0.2% magnesium and the balance copper was prepared as follows. The alloy was DC cast, hot rolled at an initial temperature of about 900° C. to a gauge of 0.445". The alloy was then coil milled to a gauge of 0.390" to remove surface oxides, cold rolled to 0.090", strip annealed at 830° C., cold rolled again to 0.030" and again strip annealed at 830° C. Samples of the alloy were then given cold roll reductions of 15%, 30%, 45%, or 60%, respectively. The samples thus treated were subjected to standard tests for measuring electrical conductivity, strength properties, bend formability, and stress relaxation in bending at a temperature of 105° C.

For comparison purposes, samples of copper alloy C510 having a nominal composition of 5.0% tin, 0.1% phosphorous, 0.15% zinc and the balance copper were prepared in the following manner. The alloy was Durville cast and coil milled to remove the cast surface. The material was then cold rolled to 0.250", annealed at 550° C. for 2 hours, cold rolled to 0.120", annealed again at 550° C. for 2 hours and cold rolled to 0.060". The material at 0.060" was then cut in half. One-half of the material was annealed at 400° C. for 1 hour and the other one-half was annealed at 600° C. for 1 hour. Samples were then given cold rolling reductions of 20%, 30%, 45%, or 60%. The samples were then subjected to standard tests for measuring strength properties, bend formability and stress relaxation.

The alloy of the present invention was found to have an electrical conductivity of 18% IACS whereas alloy C510 has an electrical conductivity of 15% IACS. Table I below reports the strength and bending properties of the copper-aluminum-nickel-magnesium alloy of the present invention given cold rolling reductions of 15%, 30%, 45% and 60%. Table II below reports the strength and bending properties of copper alloy C510 given cold rolling reductions of 20%, 30%, 45%, and 60%. It can be seen from these tables that the alloys of the present invention have properties comparable to or better than those of alloy C510. The stress relaxation properties of an alloy in accordance with the present invention and alloy C510, exposed to a temperature of 105° C. for about 100,000 hours, are illustrated in FIG. 1.

TABLE I

| % CR (%) | YIELD STRENGTH (ksi) | TENSILE STRENGTH (ksi) | % ELONG IN 2.0" (%) | 90° BEND GW | 90° BEND BW |
|---|---|---|---|---|---|
| 15 | 60.6 | 78.3 | 27.0 | 0 | 0 |
| 30 | 82.0 | 96.1 | 10.5 | 0 | 2.3 |
| 45 | 93.3 | 108.0 | 4.5 | 0.5 | 5.2 |
| 60 | 96.7 | 114.7 | 3.0 | 1.3 | 7.1 |

TABLE II

| % CR (%) | YIELD STRENGTH (ksi) | TENSILE STRENGTH (ksi) | % ELONG IN 2.0" (%) | 90° BEND GW | 90° BEND BW |
|---|---|---|---|---|---|
| 20 | 65.6 | 71.5 | 21.0 | 0 | 0.3 |
| 30 | 79.3 | 84.2 | 11.0 | 0.7 | 2.6 |
| 45 | 94.4 | 98.7 | 3.5 | 0.9 | 5.5 |
| 60 | 104.1 | 108.5 | 1.5 | 1.2 | 10.0 |

As previously mentioned, the test results clearly demonstrate that the alloys of the present invention possess properties comparable to or better than those of alloy C510. This makes these alloys particularly desirable since they will cost less than alloy C510 because of their low mix value. It is believed that the alloys of the present invention will cost about 20% to about 30% less than alloy C510.

EXAMPLE II

The following example was performed to demonstrate the effect of aluminum solute level on the longitudinal tensile and bend formability properties of a copper-aluminum-nickel-magnesium alloy system. The alloys that were investigated are summarized in Table III. The alloys were Durville cast and poured at a temperature in the range of about 1100° C. to about 1150° C. The alloys were then hot rolled to 0.400" after starting at a temperature of 700° C. An eight inch length of plate was cut from the ingot and coil milled to remove surface oxide. The plate was then cold rolled to 0.140", annealed at 525° C. for 2 hours, cold rolled to 0.060" and annealed at 450° C. for 3 hours. Samples of this metal were then further cold rolled 30%, 45%, 60% or 75% and the longitudinal tensile and good way/bad way bend characteristics were determined using standard tests.

TABLE III

| ALLOY | COMPOSITION (wt %) Al | Ni | Mg | Si | Sn | Cu |
|---|---|---|---|---|---|---|
| A | 3.15 | 0.54 | 0.20 | — | — | bal. |
| B | 4.13 | 0.54 | 0.19 | — | — | bal. |
| C | 4.97 | 0.52 | 0.20 | — | — | bal. |
| D | 5.97 | 0.54 | 0.19 | — | — | bal. |
| E | 3.97 | 0.53 | 0.19 | 0.105 | — | bal. |
| F | 3.93 | 0.52 | 0.20 | — | 0.11 | bal. |

Figure 2:
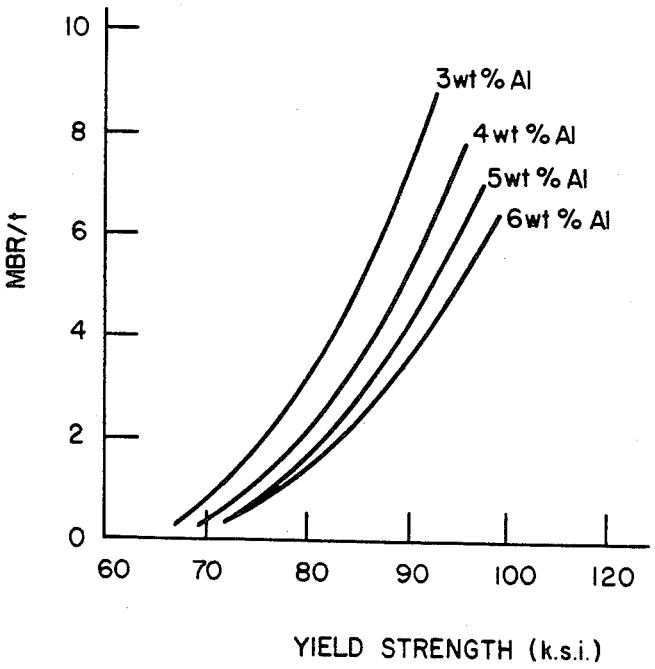
FIG. 2 is a graph illustrating the effect of aluminum on the strength vs. bend performance of Cu-Al-0.5Ni-0.2Mg alloys.

The longitudinal tensile and bend properties of these alloys are given in Table IV. The effect of aluminum level on the longitudinal yield strength versus bad way bend performace of the these alloys is illustrated in FIG. 2.

TABLE IV

| ALLOY | % CR (%) | YIELD STRENGTH (ksi) | TENSILE STRENGTH (ksi) | % ELONG IN 2.0" (%) | 90° BEND GW | BW |
|---|---|---|---|---|---|---|
| A | 30 | 70.5 | 74.8 | 9.0 | sharp | 1.1 |
| | 45 | 81.1 | 87.6 | 4.0 | sharp | 2.8 |
| | 60 | 87.0 | 95.0 | 3.0 | 0.3 | 6.5 |
| | 75 | 91.0 | 99.5 | 3.0 | 0.5 | 8.3 |
| B | 30 | 78.4 | 89.7 | 9.0 | 0.2 | 2.2 |
| | 45 | 90.3 | 101.7 | 4.0 | 0.2 | 4.6 |
| | 60 | 94.6 | 106.8 | 3.0 | 1.3 | 7.8 |
| | 75 | 96.7 | 108.8 | 2.0 | 2.1 | 10.4 |
| C | 30 | 81.7 | 96.2 | 9.0 | 0.4 | 2.6 |
| | 45 | 91.3 | 109.5 | 4.0 | 0.2 | 5.5 |
| | 60 | 98.2 | 115.5 | 3.0 | 0.7 | 6.5 |
| | 75 | 102.1 | 117.2 | 2.0 | 2.1 | 10.4 |
| D | 30 | 88.2 | 107.0 | 7.5 | 1.1 | 3.0 |
| | 45 | 101.6 | 118.7 | 3.5 | 0.5 | 7.4 |
| | 60 | 102.5 | 123.9 | 3.0 | 2.0 | 7.8 |
| | 75 | 106.7 | 125.0 | 2.0 | 2.1 | 12.5 |
| E | 30 | 80.1 | 91.0 | 9.5 | 0.4 | 2.6 |
| | 45 | 91.3 | 102.0 | 3.0 | 0.2 | 5.5 |
| | 60 | 98.5 | 108.6 | 3.0 | 1.3 | 7.8 |
| | 75 | 96.0 | 108.6 | 2.0 | 2.1 | 8.3 |
| F | 30 | 78.7 | 89.6 | 9.5 | 0.7 | 2.6 |
| | 45 | 91.5 | 101.4 | 3.0 | 0.2 | 7.4 |
| | 60 | 95.0 | 108.7 | 3.0 | sharp | 7.8 |
| | 75 | 97.7 | 110.0 | 2.0 | 3.1 | 10.4 |

The data indicates that the bend to tensile strength properties of the copper-aluminum-nickel-magnesium alloy system increase about 7 ksi for each weight percentage addition of aluminum. The data plotted in FIG. 2 indicates that the bend to yield strength properties of the copper-aluminum-nickel-magnesium alloys increase as the aluminum content increases. The regime of 1 to 3 $M_{BR}/t$ is of particular interest since most connector applications require that the material have certain bending properties in the 1 to 3t regime. As used herein, $M_{BR}$ is the minimum bend radius and t is the thickness.

EXAMPLE III

Tests were conducted to determine the effect of aluminum on the ordering hardening response of the alloys of the present invention. Samples were prepared as in Example II with the exception that they were all given a final cold rolling reduction of 45% to 0.033" gauge. Thereafter, samples of each alloy were relief annealed at 240° C. for two hours. The longitudinal tensile strength properties of these samples were then measured using standard test procedures. Other samples of each alloy were given one of the following treatments: anneal at 75° C. for 18 hours; anneal at 125° C. for 18 hours; or anneal at 175° C. for 18 hours. The yield strength of these samples were then measured using standard testing procedures.

Figure 3:
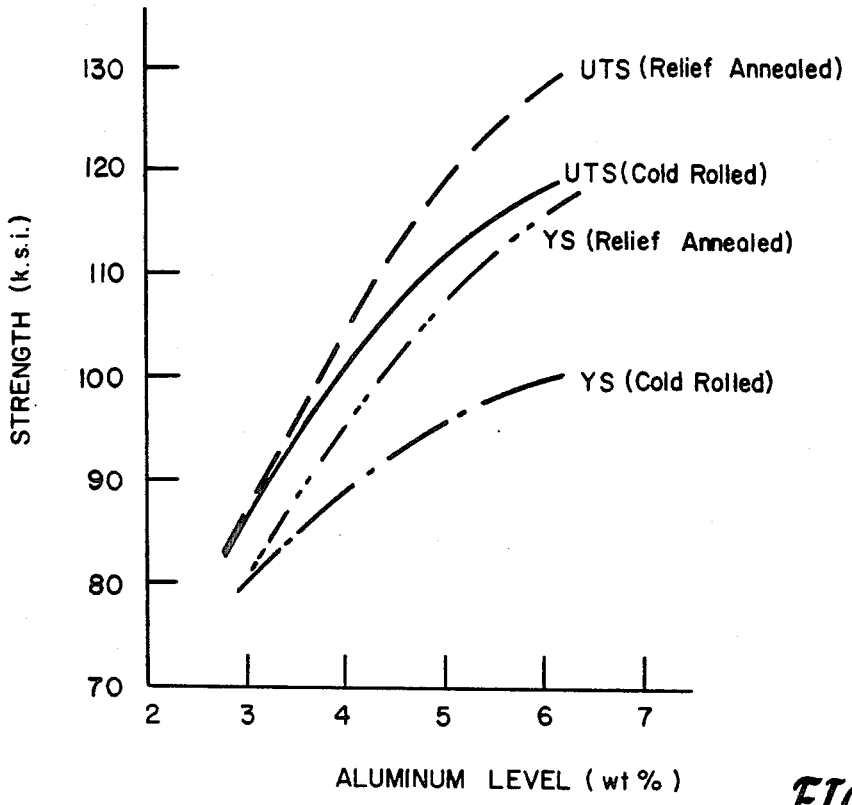
FIG. 3 is a graph illustrating the effect of aluminum on the stability of the tensile properties of a Cu-Al-0.5Ni-0.2Mg strip cold rolled 45% and annealed at 240° C. for 2 hours.
Figure 4:
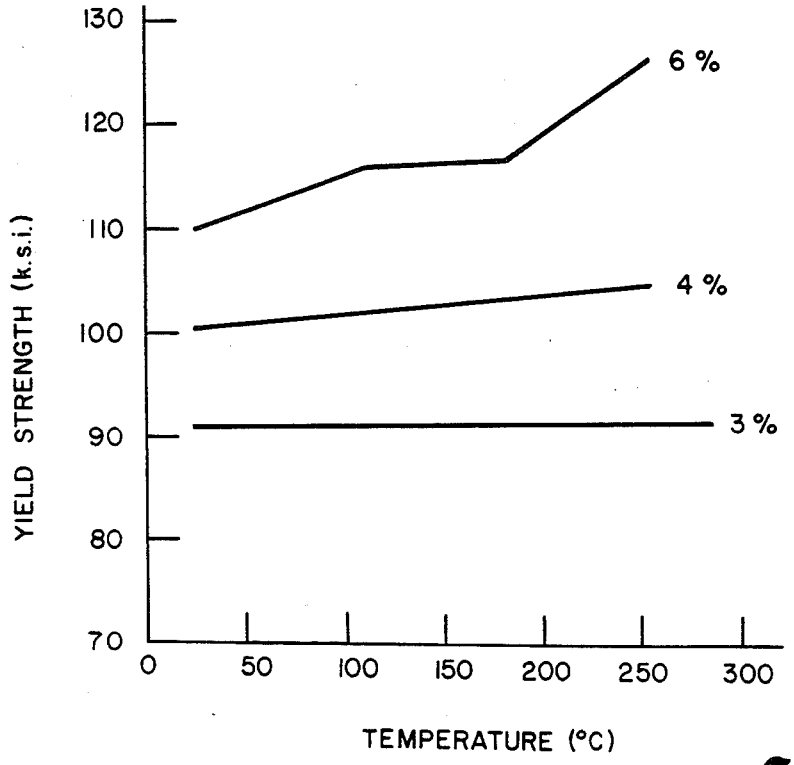
FIG. 4 is a graph illustrating the effect of the aluminum level on low temperature strengthening response of Cu-Al-0.5Ni-0.2Mg alloy strip.

FIG. 3 illustrates the effect of aluminum content on the stability of longitudinal tensile properties of strip cold rolled 45% and relief annealed at 240° C. for 2 hours. FIG. 4 illustrates the effect of aluminum level on low temperature strengthening response.

EXAMPLE IV

To demonstrate the effect of nickel content in the alloys of the present invention on the bend-to-strength properties of the alloys, Durville ingots of a copper-nickel-aluminum-magnesium alloy were cast. The nickel levels investigated were 0.2, 0.6, and 1.0 wt % at fixed values of 4.5% aluminum and 0.2% magnesium. The alloys were Durville cast, soaked at 850° C. for two hours, hot rolled to 0.40" gauge, coil milled, cold rolled to 0.090", annealed at 525° C. for 2 hours and cold rolled to 0.060". Alloy samples were then annealed at about 400° C. for 1 hour.

Figure 5:
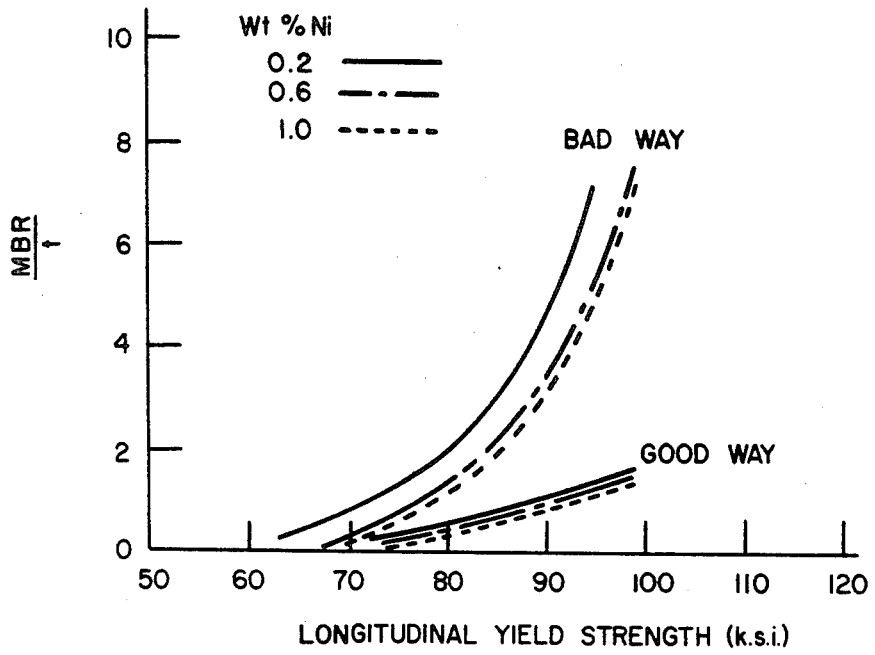
FIG. 5 is a graph illustrating the effect of nickel in Cu-Ni-4.5Al-0.2Mg alloys on strength vs. bend performance.

After processing, the samples were subjected to standard tests for measuring strength and bend formability. FIG. 5 illustrates the effect of the nickel content in these alloys on the bend-to-strength properties of the alloys.

It is believed that the foregoing discussion illustrates the many advantages of the alloys of the present invention. These alloys have been found to have mechanical properties equivalent to or better than other copper base alloys used in similar applications. The alloys of the present invention are particularly advantageous because they are able to be processed in a straight forward manner to finish gauge product and because they are cost effective.

The patents, foreign patent publication and other publications set forth in the specification are intended to be incorporated by reference herein.

It is apparent that there has been provided in accordance with this invention a low cost connector alloy which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A copper base alloy consisting essentially of from about 3.5% to about 6.0% aluminum, from about 0.1% to about 3.0% nickel, from about 0.03% to about 1.0% magnesium, and the balance essentially copper.

2. The copper base alloy of claim 1 further consisting essentially of said copper being present in an amount greater than about 90.0%.

3. The copper base alloy of claim 1 further consisting essentially of said copper being present in an amount greater than about 93.0%.

4. The copper base alloy of claim 1 further consisting essentially of said aluminum content being in the range of from about 3.8% to about 5.2%.

5. The copper base alloy of claim 1 further consisting essentially of said aluminum content being in the range of from about 4.2% to about 4.9%.

6. The copper base alloy of claim 1 further consisting essentially of said nickel content being in the range of from about 0.2% to about 1.0%.

7. The copper base alloy of claim 1 further consisting essentially of said nickel content being in the range of from about 0.3% to about 0.8%.

8. The copper base alloy of claim 1 further consisting essentially of said magnesium content being in the range of from about 0.05% to about 0.4%.

9. The copper base alloy of claim 1 further consisting essentially of said magnesium content being in the range of from about 0.1% to about 0.25%.

10. The copper base alloy of claim 1 further consisting essentially of up to about 0.1% manganese, up to about 0.05% of cobalt and iron, up to about 0.005% chromium, up to about 0.3% zinc, up to about 0.05% tin, up to about 0.05% silicon, up to about 0.015% lead and up to about 0.005% phosphorous.

11. The copper base alloy of claim 1 further consisting essentially of said alloy being in a solid solution strengthened condition.

12. A copper base alloy consisting essentially of from about 3.8% to about 5.2% aluminum, from about 0.2% to about 1.0% nickel, from about 0.05% to about 0.4% magnesium and the balance essentially copper.

13. The copper base alloy of claim 12 further consisting essentially of from about 4.2% to about 4.9% aluminum, from about 0.3% to about 0.8% nickel, from about 0.1% to about 0.25% magnesium and the balance being essentially copper.

14. The copper base alloy of claim 12 further consisting essentially of said alloy being in a solid solution strengthened condition.

15. An electrical connector formed from a copper base alloy consisting essentially of from about 3.5% to about 6.0% aluminum, from about 0.1% to about 3.0% nickel, from about 0.03% to about 1.0% magnesium and the balance essentially copper.

16. The electrical connector of claim 15 wherein said alloy consists essentially of from about 3.8% to about 5.2% aluminum, from about 0.2% to about 1.0% nickel, from about 0.05% to about 0.4% magnesium and the balance essentially copper.

17. The electrical connector of claim 15 wherein said alloy consists essentially of from about 4.2% to about 4.9% aluminum, from about 0.3% to about 0.8% nickel, from about 0.1% to about 0.25% magnesium and the balance essentially copper.

* * * * *